United States Patent [19]

Hartman

[11] Patent Number: 4,562,962

[45] Date of Patent: Jan. 7, 1986

[54] SPRINKLING SYSTEM AND VALVE THEREFOR

[76] Inventor: Woody W. Hartman, 73-135 Guadalupe Ave., Palm Desert, Calif. 92260

[21] Appl. No.: 496,431

[22] Filed: May 20, 1983

[51] Int. Cl.[4] ..... B05B 15/06

[52] U.S. Cl. ..... 239/200; 239/207; 239/569; 137/68.1

[58] Field of Search ..... 239/200, 207, 569; 251/66; 137/67, 68 R; 222/541

[56] References Cited

U.S. PATENT DOCUMENTS

| | | | |
|---|---|---|---|
| 1,124,693 | 1/1915 | Brown | 239/32 |
| 2,048,388 | 7/1936 | Johnsen | 137/68 R |
| 3,586,019 | 6/1971 | Thomas | 137/68 R |
| 4,064,889 | 12/1977 | Gayle et al. | 137/68 R |
| 4,171,095 | 10/1976 | Filan et al. | 239/200 |
| 4,393,992 | 7/1983 | Strunk et al. | 239/200 |

*Primary Examiner*—Andres Kashnikow
*Assistant Examiner*—James R. Moon, Jr.
*Attorney, Agent, or Firm*—I. Louis Wolk

[57] ABSTRACT

A sprinkler or water circulating system having a selected number of sprinkler heads, bubblers or the like, each having an associated valve mechanism adapted to effect valve closure upon displacement of the sprinkler head, bubbler, etc., during water flow thereby preventing loss of sprinkler effect and fluid. A normally open spring loaded valve is positioned in a conduit to which the sprinkler head or the like is attached. A stem or rod is positioned in engagement between sprinkler head and valve so that upon displacement the stem may be broken off if of frangible material, or otherwise displaced and the valve is urged into closed position. Upon replacement of the sprinkler head or the like in proper position the rod is replaced to maintain the valve in open position.

7 Claims, 10 Drawing Figures

SPRINKLING SYSTEM AND VALVE THEREFOR

BACKGROUND OF THE INVENTION

Sprinkler and water circulating systems are utilized for watering lawns, golf courses and agricultural areas which incorporate a plurality of various types of water distributing heads attached to underground or above ground piping systems. Normally these systems provide manually or automatically operable valves at selected points to control water flow to groups of sprinklers, bubblers or the like. These may be operated by timers which permit water flow for predetermined time periods. In any event these valves remain open during such a time period so that if for any reason the sprinkler head is displaced, unrestricted water flow and loss of sprinkling effect and wastage of water may occur. Such displacement may result from impact upon a protruding head by a gardner or a mower, by loosening of a joint, breakage of a conduit or nipple, or other damage. Since such systems are usually unattended and may rely upon automatic timing systems, it is obvious that some means for preventing undesired flow upon disruption of the sprinkler head would be desirable.

In the prior art, as shown by U.S. Pat. No. 2,980,125, a valve is provided which will close upon impact by breakage of a barrel which supports a valve stem. In U.S. Pat. No. 4,064,889, a spring loaded normally open valve is closed upon breakage of a conduit having a weakened portion. However, such devices are not suitable for use in sprinkling systems of the type considered herein since replacement of broken conduits is costly and time consuming, and since in most cases, the problem of sprinkler displacement occurs through damage to or loosening of the sprinkler head itself rather than the conduit to which it is attached.

SUMMARY OF THE INVENTION

In accordance with the present invention, a normally open spring loaded valve is positioned in a conduit leading to a sprinkler head connecting thereto. The valve with its stem is kept in open position by means of a spring under load in engagement with a spring retaining member, which in turn is retained against the spring by means of an elongated rod extending between it and an inner portion of the sprinkler head. This rod may be of frangible material such as glass or breakable plastic or brittle metal, or may not be frangible but easily bent or displaced. If for any reason the sprinkler head is displaced or the conduit to which it is attached is removed or broken, the stem will be forced upward or broken off, thus releasing pressure upon the spring, causing the valve to close and shut off the flow of water or other fluid to that particular conduit. At the same time deposit of dirt or debris in the sprinkler head is minimized or eliminated.

This principle is applied to various types of water distributing devices attached to circulating systems in different ways, including spray and sprinkler heads, bubblers, rotary spray devices such as "Rain Birds", as hereinafter described. The invention is applicable to either plastic or metal conduits or combinations thereof.

DETAILED DESCRIPTION

Figure 1:
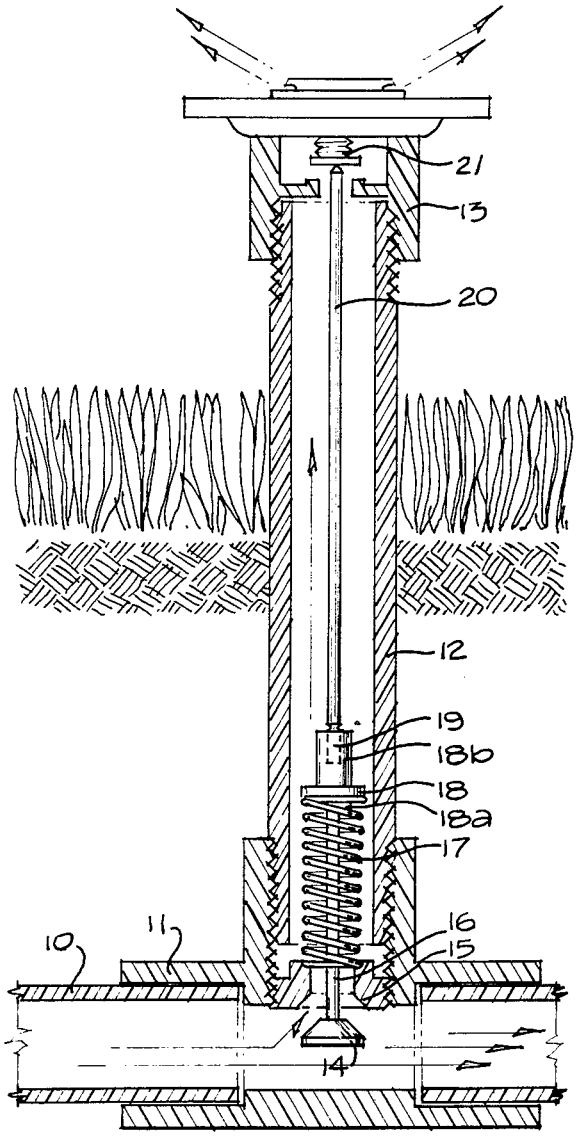
FIG. 1 is a vertial cross sectional view of the invention showing a portion of an underground conduit supplying water through a vertical nipple to a common type of sprinkler head, with the valve in open position.
Figure 2:
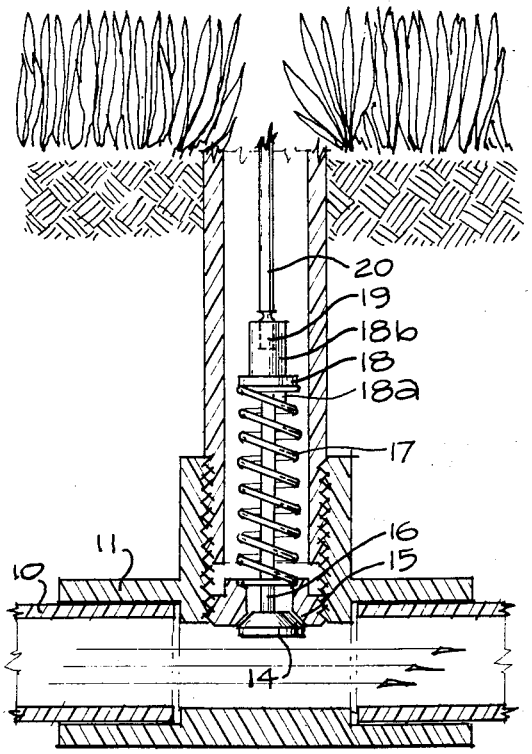
FIG. 2 is a view corresponding to FIG. 1 showing the structure which results if the sprinkler head and conduit are broken off at the ground surface resulting in valve closure.

As shown in FIG. 1, underground conduit 10 is a component of an underground watering system in which a tee connection 11 diverts water into a vertical nipple 12 which extends above the ground surface and to which is attached a sprinkler head 13. A valve assembly comprising a valvehead 14, a valve seat 15, and a valve stem 16 is positioned within the vertical threader portion of the tee as shown. Spring member 17 is positioned between the valve seat member and a circular plate 18 to permit compression and decompression of the spring. Plate 18 carries a bottom circular enlargement of 18*a* dimensioned to nest within the upper coil of spring 17 and having a recess 18*c* (shown in FIG. 3) adapted to receive the upper end of the valve stem 16. The upper surface of plate 18 carries an enlargement 18*b* which has a recess 19 adapted to retain the bottom end portion of a rod 20 the upper end of which is in engagement with the bottom of sprinkler head 13 at its adjusting screw 26. Where there is no adjusting screw, the engagement is against the bottom of the sprinkler. The frangible rod is preferably made of glass or a breakable plastic such as rigid polystyrene, polyvinyl chloride or other rigid plastic or brittle metal alloy which will tend to break rather than bend when stressed. The length of the rod is selected so that when it is in place and the sprinkler head is screwed down, it will depress the spring and valve steam by bearing against the retaining plate 18 to retain the valve head in open position. Upon breakage of the nipple 12, or displacement of the sprinkler head, the rod will be forced upward, or break, or both, thus releasing the spring and forcing valve head 14 against its seat thus shutting off the water flow.

Figure 3:
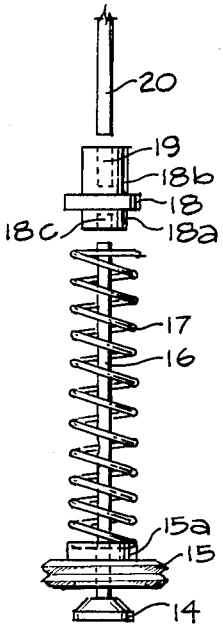
FIG. 3 is a view in elevation illustrating a valve assembly or the invention.

The detailed view of the valve unit is shown in FIG. 3, in which is illustrated valve head 14, threaded valve seat 15, valve stem 16, and spring 17 positioned between upper and lower spring retaining members 18 and 15*a*, and recesses 18*c* and 19 to receive the upper end of the valve stem and the lower end of frangible rod 20.

Figure 4:
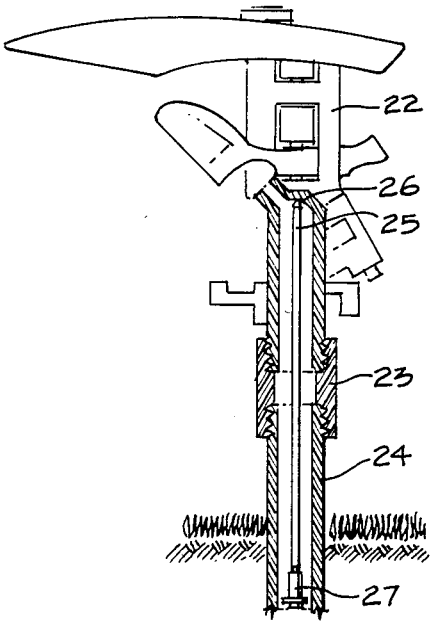
FIG. 4 is a view partly in vertical cross section and partly in elevation showing the frangible or removable stem utilized with a "Rain Bird" type of sprinkler head.

FIG. 4 shows a rotary sprinkler of the "Rain Bird" type 22, attached to a coupling 23, which is in turn attached to a nipple 24 which leads to a tee connected to an underground conduit as shown in FIG. 1. A frangible rod 25 bears against an inner surface of the sprinkler head as shown at 26, and is supported at its lower end in a recess in extension 27 in a spring loaded valve unit mounted in the tee.

Figure 5A:
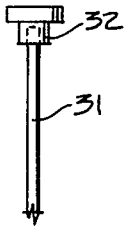
FIG. 5*a* is a detail view of the stem used in FIG. 5.
Figure 5:
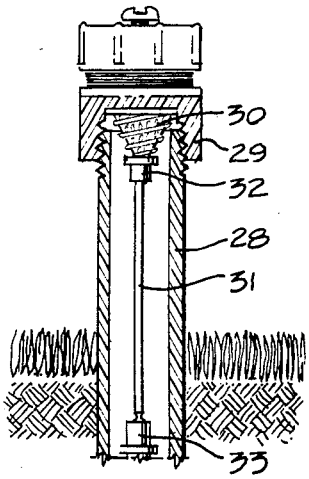
FIG. 5 is a view, partly in vertical cross section showing the frangible or removable stem associated with a conventional bubbler type of head.

FIGS. 5 and 5*a* show the use of bubbler head with the frangible stem in which a vertical conduit or nipple 28 is connected underground with the valve system shown in FIG. 1. A bubbler head 29 is attached at the upper end by threads provided therefor. The bubbler is usually provided with a filter 30. A frangible rod 31 of the type described is inserted at the upper end into a recess in the base of a small flat plate member 32 which bears against the inverted cone as shown. The lower end of the rod is inserted into a recess in the upper position of member 33 the lower surface of which bears against a spring and valve stem assembly in FIG. 1. The length of the frangible rod is selected to ensure that the spring is compressed and the valve kept open by pressure upon the spring when the rod is in place. Upon breakage of the vertical conduit or bubbler, or removalb by loosening, the rod will break or be forced upward, thereby releasing the spring and forcing the valvehead to close as described above.

Figure 6:
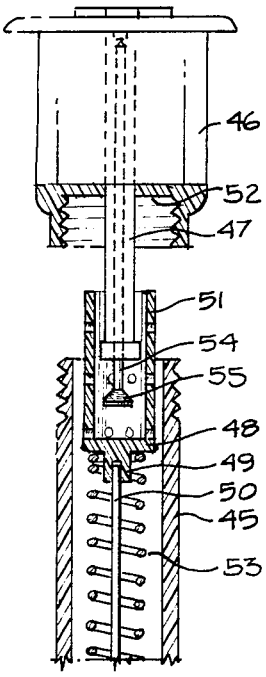
FIG. 6 is a partial cross sectional view of the invention as applied to a "pop-up" type of sprinkler head.
Figure 6A:
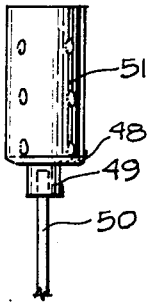
FIG. 6*a* is a detail view showing a modified structure of a hollow frangible or removable rod utilized in the pop-up structure of FIG. 6.
Figure 6B:
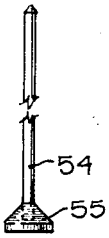
FIG. 6*b* is a detail view of a frangible or removable rod used in the pop-up element of FIG. 6.
Figure 7:
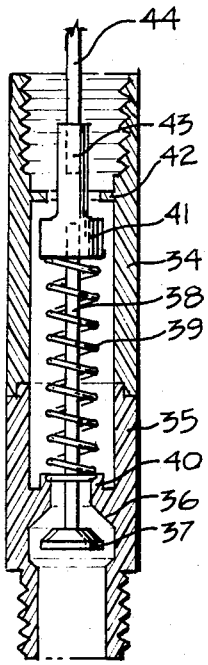
FIG. 7 is a vertical cross sectional view of the valve and spring assembly of the invention enclosed in a separate unit suitable for insertion into a fluid flow system.

FIG. 6 illustrates the invention as applied to a conventional "pop-up" type of sprinkler head. As shown, sprinkler head 46 is to be attached to nipple 45, which is in turn connected to a water supply system. Pop-up conduit 47 is designed to become elevated in response to water pressure and spray water through a spray opening (not shown). A valve stem 50 is connected to a valve head such as shown in FIG. 1 and at its upper end is inserted into a sleeve member 49 supporting a plate 48, which supports a perforated hollow rod or cylinder 51. This cylinder is designed to surround pop-up member 47 and bear against the base 52 of the sprinkler head, and is selected to be of sufficient length as to compress the valve stem 50 against spring 53 to depress the valvehead as shown in FIGS. 1 and 7 to retain the valve in open position as long as the cylinder is in place. The cylinder may be frangible and formed of brittle glass, metal or plastic and is perforated to permit water flow when it is is place. Upon breakage of the nipple, or disruption of the sprinkler head, the cylinder or hollow rod will break or be dislocated allowing the spring to draw the valvehead closed and shut off the flow of water. However, in case the pop-up sprinkler 47 is broken off while in the up position without disruption of the sprinkler head 46, provision is made for shutting off the flow of water by also inserting within pop-up 47 a frangible or removable rod 54 of the type described in connection FIGS. 1–5 having a length slightly longer than the length of the pop-up stem and provided with a soft rubber or plastic seal or gasket 55 as shown in detail in FIG. 6*b*. This gasket is dimensioned to engage the base of the stem and shut off water flow if the top of the stem should be broken off by being forced against the base under water pressure. During normal use the pop-up stem conveys the water to its sprinkling tip and since the length of 54 is greater then 47, a space is provided between gasket 55 and the base of the stem to permit water flow. While a conical gasket or seal is illustrated, a rubber ring such as an "O" ring may be used surrounding the rod.

In FIG. 7, the valve assembly of the invention is shown in partial cross section enclosed in a separate sealed unit which can be inserted into a tee or elbow joint in a conduit. As shown, a sleeve enclosure is provided which can be assembled in two parts 34, 35 the lower part being formed or provided with a valve seat insert 36. Valvehead 37 with valve stem 38 are inserted as shown with the base of the spring 39 supported upon an inner flange in 35 and the upper end of the stem inserted within a recess in cylindrical member 41 having a narrower upwardly extending portion 42 and retained in position in sleeve member 34 by means of an inner flange 42.

After the members are assembled, the sleeve portions 34 and 35 are sealed together by cement or otherwise and the assembled unit can then be inserted into a threaded joint in a fluid supply conduit. A desired type of sprinkler head can then be attached by means of a suitable threaded sleeve or nipple. The break-away aspect of the invention is provided by inserting a frangible rod 44 into a recess 43 which is formed in projecting member 42 and selected to be of suitable length to bear against the inner surface of the sprinkler and compress the spring to open the valve and retain it in that position until broken or removed.

As stated above, the rod which controls the open or closed position of the valve head may be of frangible material, it may also be non frangible plastic or metal and will function through displacement when the head or its supporting nipple is dislocated.

As described above, the invention is applicable to watering systems using multiple conduits and various types of sprinklers or water distributing members in which loss or wastage of water through damage or removal of the sprinkler heads during water flow can be eliminated. Once a head is inactivated by breakage of the frangible rod or displacement thereof if not broken or frangible, it can be easily replaced by inserting a fresh rod of suitable length and reattaching the head. Although the invention has been described in connection with water flow systems, it may also be utilized in other situations or with other fluids where cut off of flow is desired.

I claim:

1. A water and other fluid distributing system which comprises a fluid supply conduit, one or more subsidiary conduits each having one end affixed to and communicating at its base with said supply conduit and the other end affixed to and communicating with a fluid distributing head, a valve means positioned within each said subsidiary conduit at its base comprising a valve seat and a valve head associated therewith, a valve stem attached to said valvehead at one end and to a compression plate at the other end, a spring surrounding said valve stem positioned between said valve seat and said compression plate, said valve head being maintained in open position during fluid flow to said distributing head with respect to said valve seat while said spring is under compression between said compression plate and said valve seat and in closed position when said compression is removed, a displaceable compression rod positioned concentrically within said subsidiary conduit between and in engagement with the base of said distributing head and said compression plate, the length of said rod being such that said rod and spring are under compression to maintain the valve in open position during water flow whereby disruption or removal of said rod will release compression of said spring and permit closure of said valve head upon said valve seat.

2. A device according to claim 1 wherein the compression rod is formed of readily frangible material.

3. A device according to claim 1 wherein the distributing head is of the stationary sprinkler type.

4. The device according to claim 1 wherein the distributing head is of the rotary sprinkler type.

5. A device according to claim 1 wherein the distributing head is a water bubbler.

6. A device according to claim 1 wherein the water distributing head is of the "pop-up" type and in which the rod is a perforated cylinder surrounding a pop-up sleeve.

7. A device according to claim 6 wherein a rod of greater length than the pop-up member is positioned therein having a sealing member attached at the bottom end thereof adapted to engage the base of the pop-up member under water pressure in the event of breakage thereof.

* * * * *